US006582561B2

(12) United States Patent
Bernhard

(10) Patent No.: US 6,582,561 B2
(45) Date of Patent: Jun. 24, 2003

(54) APPARATUS FOR FORMING AN EXTENDED NIP

(75) Inventor: Brendel Bernhard, Grefrath (DE)

(73) Assignee: Eduard Kusters Maschinenfabrik GmbH & Co. KG, Krefeld (DE)

( * ) Notice: Subject to any disclaimer, the term of this patent is extended or adjusted under 35 U.S.C. 154(b) by 0 days.

(21) Appl. No.: 10/219,447

(22) Filed: Aug. 13, 2002

(65) Prior Publication Data

US 2003/0034140 A1 Feb. 20, 2003

(51) Int. Cl.[7] ..... D21F 3/00

(52) U.S. Cl. ..... 162/358.5; 162/272; 162/358.3; 100/327

(58) Field of Search ..... 162/358.3, 361, 162/358.5, 206, 272; 100/327, 329, 334

(56) References Cited

U.S. PATENT DOCUMENTS 5,496,442 A * 3/1996 Laapotti ..... 162/358.5
5,693,186 A * 12/1997 Vallius ..... 162/358.3
6,126,789 A * 10/2000 Schiel et al. ..... 162/358.4

FOREIGN PATENT DOCUMENTS

DE 3503240 C2 8/1986
WO WO 01/83883 A1 11/2001

* cited by examiner

*Primary Examiner*—Karen M. Hastings
(74) *Attorney, Agent, or Firm*—Townsend and Townsend and Crew LLP

(57) ABSTRACT

Apparatus for forming an extended nip between a heated mating roll and a shoe roll for treating a product web, especially a paper web, the shoe roll having a stationary support and a flexible belt which can rotate about the support and, in the area of the extended nip, is supported on a shoe which is guided on the support, forms a press section and has an effective shoe width, and the belt having end sections which are fixed to end walls that are rotatably mounted on the support, in each case at the ends and axially adjacent to but at a distance from a mating face located opposite the effective shoe width of the shoe, the mating roll having a radially protruding support ring, which forms an opposing bearing for the direct support of an outer belt section on the mating roll and consists of a thermally insulating material.

12 Claims, 5 Drawing Sheets

APPARATUS FOR FORMING AN EXTENDED NIP

CROSS-REFERENCES TO RELATED APPLICATIONS

This application claims priority from German application no. 101 38 807.1, filed on Aug. 14, 2001, and of German application no. 102 07 371.6, filed on Feb. 22, 2002, under 35 USC §119, the full disclosures of which is incorporated herein by reference.

BACKGROUND OF THE INVENTION

The invention relates to an apparatus for forming an extended nip between a shoe roll and a mating roll for treating a product web, especially a paper web.

BRIEF SUMMARY OF THE INVENTION

Apparatus of this type, having a shoe roll with a press section, are known for treating a product web, especially for dewatering and/or calendering a paper web.

For dewatering a paper web, DE 35 03 240 C2 discloses an extended nip roll press containing a driven mating roll and a shoe roll having a stationary supporting element with a press shoe guided therein. The press shoe can be pressed hydraulically against the mating roll. An endless roll cover (belt) is laid around the supporting element. With the corresponding roll section of the mating roll, the press shoe forms an extended press nip through which the fibrous web to be dewatered, embedded between material webs, is guided in the web running direction together with the belt. For this purpose, the press shoe has an upper part which has a sliding surface along which the belt runs. The sliding surface can be selected as a function of the desired pressing pressure profile over the press nip width and imparts an effective shoe width to the press shoe. However, it has proven to be disadvantageous that the belt experiences deformations at the edges of its belt, which increase the wear of the belt.

This applies in particular when the apparatus is used for calendering, when the mating roll is heated, as disclosed for example in WO 01/83883 A1.

SUMMARY AND OBJECTS OF THE INVENTION

It is therefore an object of the invention to provide an apparatus for forming an extended nip between a heated mating roll and a shoe roll subjecting the belt to lower wear.

In particular, an apparatus is provided for forming an extended nip between a heated mating roll and a shoe roll, in which the run of the belt is stabilized by an outer belt section being supported directly on the mating roll. As a result, belt deformation is minimized. The belt is guided by the support ring in the area between the effective shoe width of the shoe and the end fixing, which ensures a substantially kink-free transition of the belt from the press section of the shoe to the respective end fixing. The support ring is preferably constructed in such a way that it permits a continuous extent of the belt outside the press section of the shoe. In addition, the support ring provides thermal insulation, which reduces thermal stress on the belt when a heated mating roll is used. The belt is therefore also subjected to lower thermal wear. The fact that the support ring combines both the supporting function and insulating function extends the service life of the belt considerably.

The support ring may consists of a fibrous cement material with a high continuous temperature resistance and very good thermal insulation. Alternatively, the support ring can consist of a temperature-resistant plastic or plastic foam. In addition, for dedicated cooling of the support ring, the latter can be penetrated by air ducts.

Supporting the belt at the edge of the pressing zone is preferably carried out by means of a radial thickness of the support ring which, at least on the shoe side, has a height which adjoins the height caused in the extended nip by the product web resting on the mating face. The belt then experiences support which follows the position predefined in the extended nip. Furthermore, the support ring can not only support the belt in a thermally insulated way but, at the same time, can also guide it towards the edge by means of a radial thickness change in the support ring, which means that a certain belt deflection from the press section of the shoe towards the end fixing can be defined. Since the belt is inflated during operation, preferably by setting an at least low positive pressure, the belt rests on the support ring of the mating roll and follows the guidance of the latter in the transition area between the effective shoe width and end fixing.

Furthermore, adjacent to its mating face, the mating roll in each case preferably has an annular depression, as a result of which the edges of the product web are allowed to run freely at the side of the press section of the shoe. Further thermal insulation is achieved if this depression has an external thermal insulating layer.

Finally, the mating roll preferably has thermally insulated journals, on which the support ring can be arranged. The mating roll can be heated by means of oil or inductively and can be designed as a hard or soft roll and also as a deflection compensating roll.

Further refinements of the invention can be taken from the dependent claims and the following description.

The invention will be explained in more detail below using exemplary embodiments illustrated in the appended drawings.

DETAILED DESCRIPTION OF THE INVENTION

Figure 1:
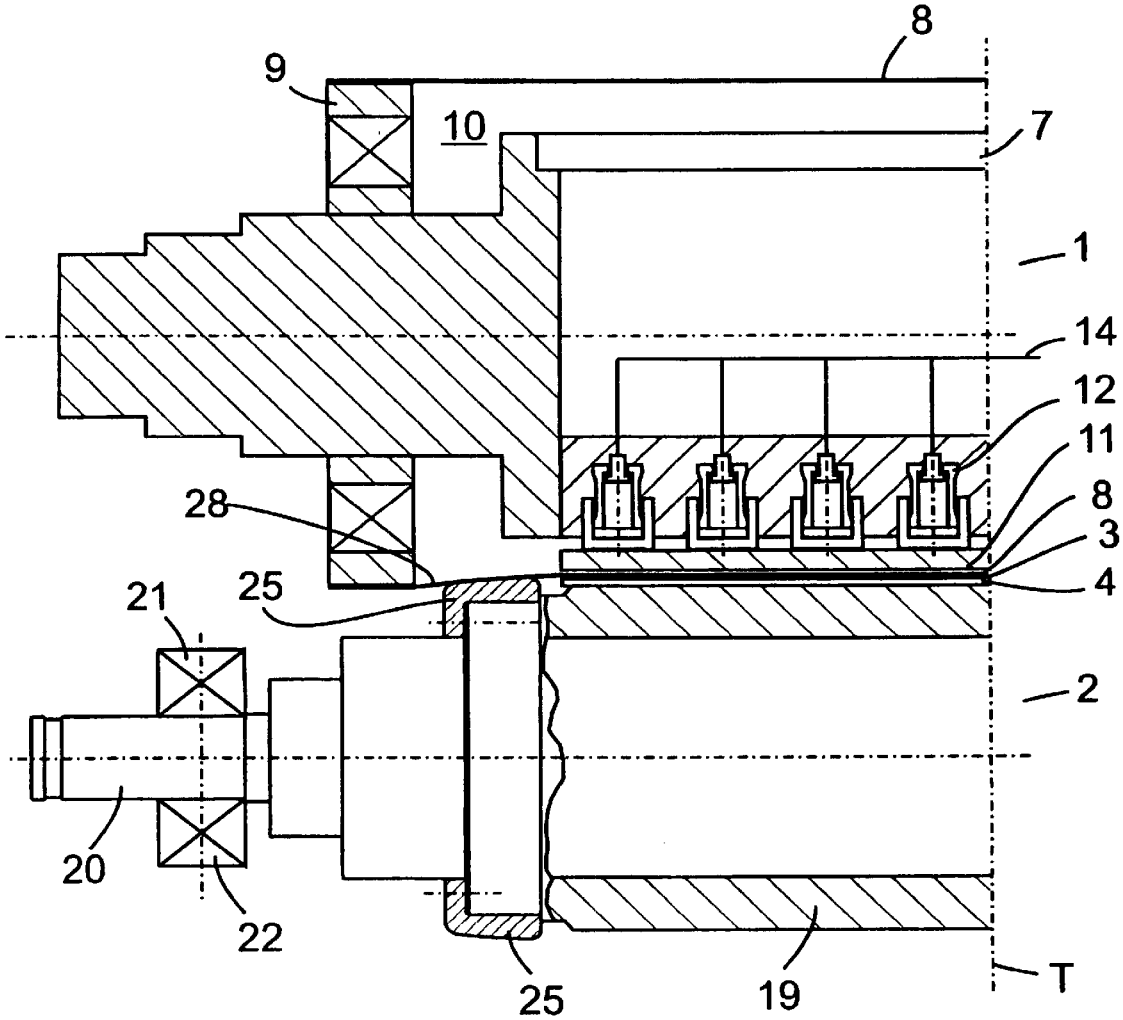
FIG. 1 shows, schematically in longitudinal section, a left-hand half of a mating roll and a shoe roll belonging to an apparatus for forming an extended nip according to a first exemplary embodiment.

The invention relates to an apparatus for forming an extended nip between a mating roll and a shoe roll for treating a product web, it being possible for the apparatus to be part of a papermaking installation. Illustrated and explained below is the left-hand half of a mating roll and a shoe roll belonging to such an apparatus. The right-hand half is designed with mirror symmetry to the dividing line T, so that the following explanations relating to the left-hand half apply correspondingly to the right-hand half.

The apparatus for forming an extended nip comprises a shoe roll 1 and a driven mating roll 2, which interact in an extended nip 3. At least one product web 4 to be treated is guided through the extended nip 3.

The shoe roll 1 comprises a stationary support 7 and a belt 8 which can rotate about the support 7 and consists of a flexible material, for example rubber or plastic. The belt (roll cover) 8 is formed like a hose and is fixed by its end sections to end walls 9 which are seated rotatably on the support 7, in order to form a closed shoe roll 1. An interspace 10 between support 7 and belt 8 is preferably supplied with compressed air, as a result of which the belt 8 is inflated in order to be given a cylindrical shape.

Provided on the support 7 is a press section, which is formed by a shoe 11 which, together with the mating roll 2, defines the extended nip 3. The shoe 11 is supported on the support 7 via a supporting bar comprising a plurality of hydraulic supporting elements 12 arranged axially spaced apart from one another, and can be pressed by the said supporting bar against the belt 8 and in the direction of the mating roll 2. The shoe 11 has an effective shoe width 13 (cf. FIG. 2*a*) on which the belt 8 is supported on the shoe 11. The effective shoe width 13 is designed as a sliding surface for this purpose. The supporting elements 12 are connected in a known manner via pressure medium lines 14 to a hydraulic pressure medium, for example oil or water.

Thus, with the corresponding belt section of the mating roll 2, the shoe 11 forms the extended nip 3, through which the at least one product web 4, together with the belt 8, is guided in a web running direction.

The mating roll 2 has a roll shell 19 which can be heated from the inside or outside, in order to design the mating roll 2 as a heated roll for temperatures of preferably up to 300° C. The mating roll 2 is in each case supported by its roll ends 20 in rotary bearings 21, 22. A drive, not illustrated, can act in a known way on the mating roll 2, in order to drive it. The mating roll can also be constructed as a deflection compensation roll having a stationary roll core and a roll shell which can rotate about the roll core and, along its outer surface is supported on the roll core by at least one supporting bar of hydraulic supporting elements. Finally, the mating roll 2 can be constructed as a hard or soft roll.

The mating roll 2 has a mating face 24 (cf. FIG. 2*a*), on which the at least one material web 4 comes into contact with the mating roll 2 in the extended nip 3. Furthermore, in each case at the end and axially at a distance from the mating face 24, the mating roll 2 has a radially protruding support ring 25, which forms an opposing bearing for the direct support of an outer belt section 28 on the mating roll 2.

By means of the support ring 25, the belt 8 is given support along its outer belt section 28 in the transition area between the effective shoe width 13 and the fixing to the end wall 9. The radial thickness of the support ring 25 is selected in such a way that a continuous extent of the belt 8 between shoe 11 and end fixing to the end walls 9 is achieved. This is achieved by the radial thickness of the support ring 25 following the height which the belt 8 assumes in the extended nip 3 because of its positioning, on the product web 4 and, if appropriate, additional material webs. In this way, the belt 8 at the ends of the extended nip 3 can continuously expand radially to the extent predefined by the end walls 9, since the belt 8 is pressed in the extended nip 3. The radial thickness of the support ring 25 therefore preferably decreases towards the edge. Since an at least slight internal pressure preferably prevails in the interior 10 of the belt 8, the belt 8 is pressed against the support ring 25 outside the extended nip 3.

The support ring 25 consists of a thermally insulating material, which preferably additionally has a low specific heat and as a result, is then a material with a low enthalpy. The thermally insulating material can be, for example, a high-temperature-resistant fibrous cement material or a high-temperature-resistant plastic. The supporting ring 25 therefore in each case provides heat-resistant thermal protection for the outer belt sections 28, the thermal insulating function being combined with the guiding function. As a result, local overstressing of the belt 8 is avoided, so that there is no longer any need to run the product webs to be treated with excess widths.

The support ring 25 can be seated on the mating roll 2 with the interposition of thermal insulation, in order also to be able to use a less temperature-resistant thermally protective material. Furthermore, the support ring 25 can in each case be penetrated by air ducts, not shown, for dedicated cooling.

Figure 2A:
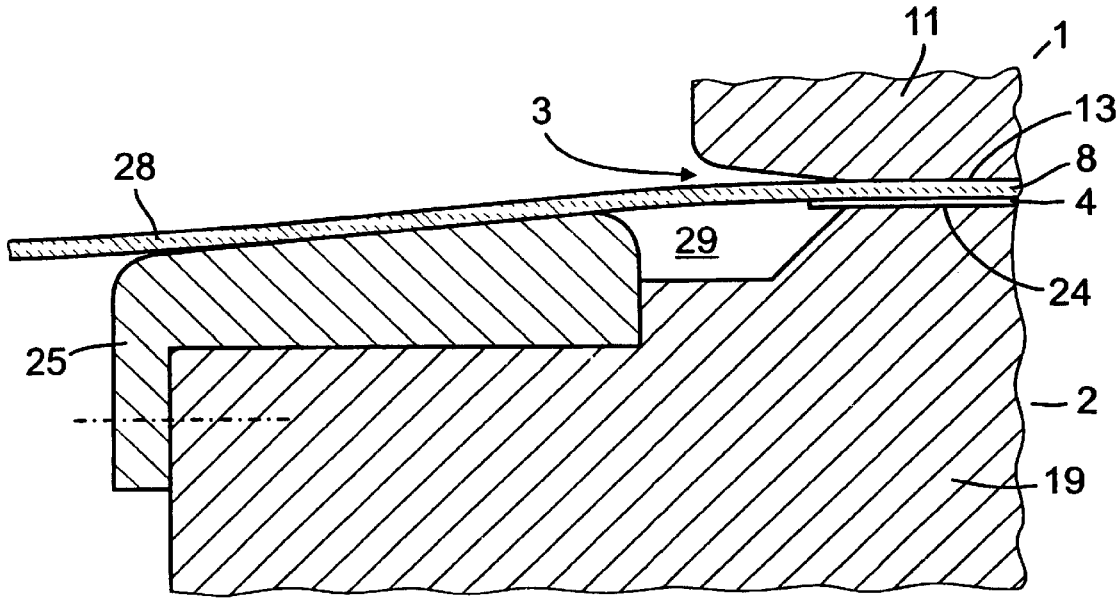
FIG. 2*a* shows, enlarged, a subarea of the longitudinal section of FIG. 1 in the area of the support ring.

As FIG. 2*a* shows, in each case axially adjacent to the mating face 24, the mating roll 2 has an annular depression 29, which permits the edges of the product web 4 to run freely at the ends.

Figure 2B:
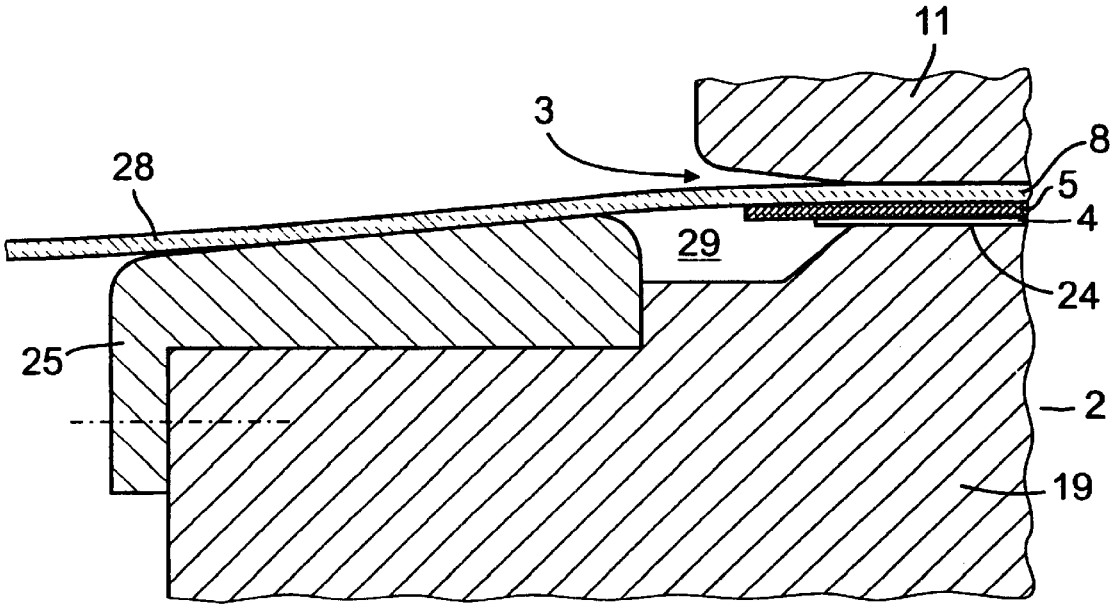
FIG. 2*b* shows the longitudinal section from FIG. 2*a* with an additional calendering cover.

FIG. 2*b* differs from FIG. 2*a* in that a calendering belt 5 is guided through the extended nip 3 together with the product web 4. The calendering belt 5 can have resilient properties which are advantageous for calendering a paper web in an extended nip. In the case of shoe widths from 25 to 100 mm, the extended nip 3 permits long dwell times at high temperatures as a replacement for high pressure stresses, which permits calendering while maintaining volume, in particular in the case of board. Pressure stresses of, for example, 8 to 12 $N/mm^2$ are adequate for such calendering here.

Figure 3:
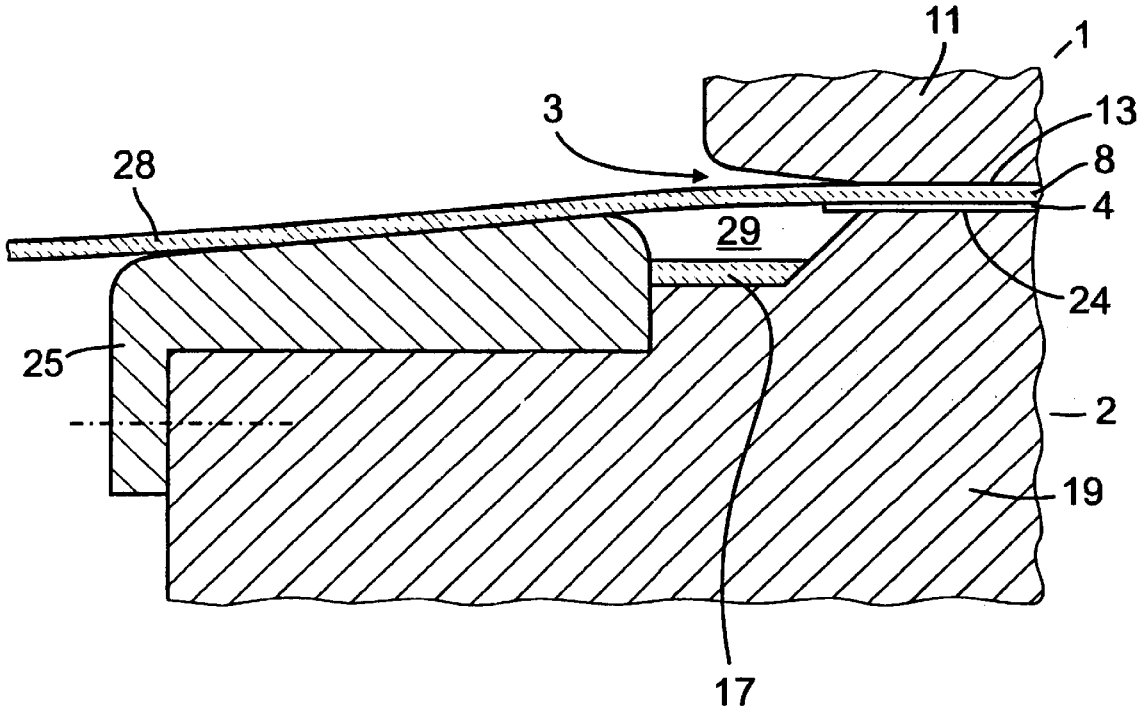
FIG. 3 shows, schematically in a longitudinal section, a subarea of a left-hand half of a mating roll and a shoe roll belonging to an apparatus for forming an extended nip according to a second exemplary embodiment.
Figure 4:
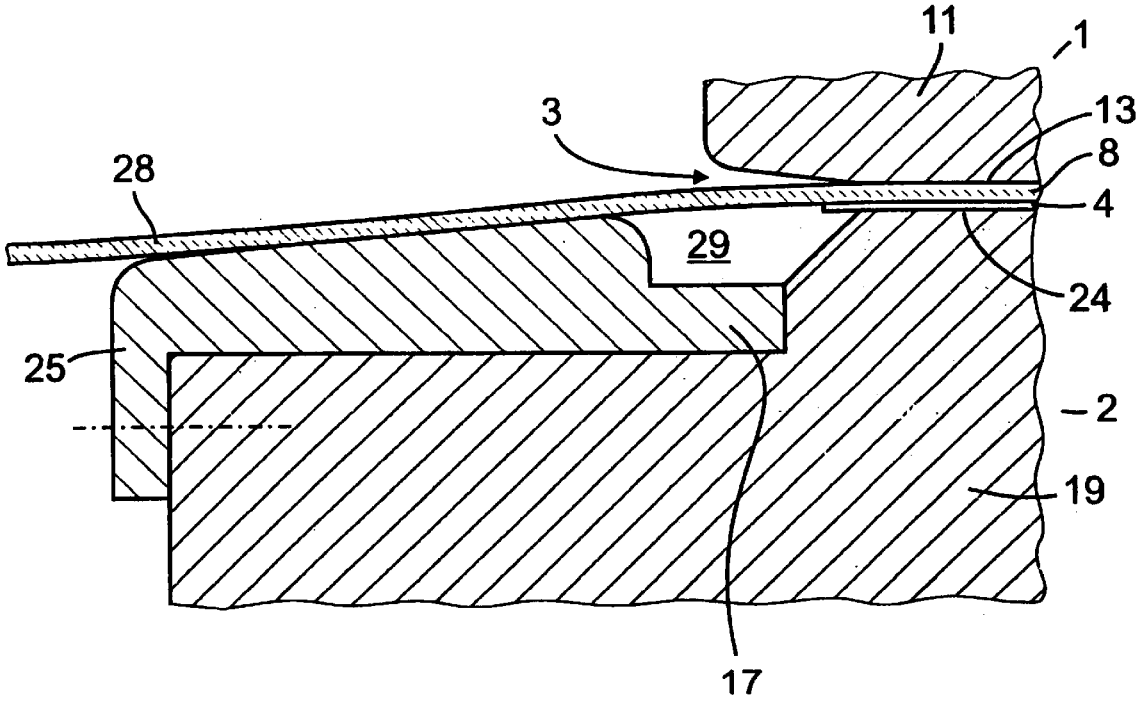
FIG. 4 shows, schematically in a longitudinal section, a subarea of a left-hand half of a mating roll and a shoe roll belonging to an apparatus for forming an extended nip according to a third exemplary embodiment.

The exemplary embodiment illustrated in FIG. 3 differs from the exemplary embodiment illustrated in FIG. 2*a* in that the mating roll 2 has a thermally insulating coating 17 in the area of its depression 29, adjacent to the mating face 24. The thermally insulating coating 17 can in addition be formed in one piece with the support ring 25, as FIG. 4 shows. Otherwise, the above explanations relating to FIGS. 1 and 2*a* apply accordingly.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. Apparatus for forming an extended nip between a heated mating roll mid a shoe roll for treating a product web the shoe roll having a stationary support and a flexible belt which can rotate about the support, wherein in the area of the extended nip, a shoe which is guided on the support (a) supports the flexible belt of the shoe roll, (b) forms a press section, and (c) has an effective shoe width, wherein the belt has end sections which are fixed to end walls that are rotatably mounted on the support, and wherein the mating roll has a radially protruding support ring at each of the end sections axially adjacent to but spaced a distance from a mating face located opposite the effective shoe width of the shoe, which mating ring forms an opposing bearing for the direct support of an outer belt section of the flexible bolt in a transition area between the effective shoe width and the fixing to the end wall on the mating roll and consists of a thermally insulating material in order to provide heat resistive thermal protection and guiding for the outer belt section.

2. Apparatus according to claim 1, wherein the support ring comprises a fibrous cement material.

3. Apparatus according to claim 1, wherein the supporting ring comprises a high-temperature-resistant plastic.

4. Apparatus according to any of claims 1 to 3, wherein the support ring in each case has a radial thickness which permits a continuous extent of the belt in the area between shoe and end fixing.

5. Apparatus according to any of claims 1 to 3, wherein the support ring in each cue has a radial thickness which, at least on the shoe side lies in the range of a height formed by a product web on the mating roll.

6. Apparatus according to any of claims 1 to 3, wherein the support ring has a radial thickness which decreases towards the edge.

7. Apparatus according to any of claims 1 to 3, wherein the support ring is in each case arranged axially at a distance from the effective shoe width of the shoe such that a free-running section for a product web remains at the end.

8. Apparatus according to claim 7, wherein in the area of the free-running section, the mating roll has an annular depression for the ends of a product web to hang over freely.

9. Apparatus according to claim 8, wherein the depression has an outer thermal protection layer.

10. Apparatus according to claim 9, wherein the thermal protection layer is formed in one piece with the support ring.

11. Apparatus according to any of claims 1 to 3, structured for calendering a product web, wherein a calendering belt is guided through the extended nip with the product web.

12. Apparatus according to any of claims 1 to 3, wherein the heated mating roll is designed as an internally hydraulically supported roll.

* * * * *

UNITED STATES PATENT AND TRADEMARK OFFICE

CERTIFICATE OF CORRECTION

PATENT NO. : 6,582,561 B2
DATED : June 24, 2003
INVENTOR(S) : Brendel

It is certified that error appears in the above-identified patent and that said Letters Patent is hereby corrected as shown below:

Title page,
Item [12], "Bernhard" should read -- Brendel --
Item [73], "Eduard Kusters Maschinenfabrik Gmbh & Co. KG, Krefeld (DE)" should read -- Eduard Küsters Maschinenfabrik Gmbh & Co. KG, Krefeld (DE) --
Item [75], "Brendel Bernhard, Grefrath (DE)" should read -- Bernhard Brendel, Grefrath (DE) --

Column 4,
Line 59, "mid" should read -- and --

Column 5,
Line 18, "cue" should read -- case --

Signed and Sealed this

Twenty-third Day of December, 2003

JAMES E. ROGAN
*Director of the United States Patent and Trademark Office*